US006776404B1

(12) United States Patent
Milillo et al.

(10) Patent No.: US 6,776,404 B1
(45) Date of Patent: Aug. 17, 2004

(54) FINISHING DEVICE HAVING A SHEET GUIDING AND BUFFERING MECHANISM

(75) Inventors: Richard J. Milillo, Fairport, NY (US); Charles F. Prevost, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/361,345

(22) Filed: Feb. 7, 2003

(51) Int. Cl.[7] ..... B42C 1/12; B65H 37/04

(52) U.S. Cl. ..... 270/58.18; 270/58.08; 270/58.14; 414/793.4; 399/410; 271/189; 271/209; 271/213

(58) Field of Search ..... 270/58.07, 58.08, 270/58.11, 58.13, 58.14, 58.01, 58.09, 58.12; 414/793.4, 790.5, 791, 789.6, 794.2, 794.9; 399/410; 271/189, 207, 209, 213

(56) References Cited

U.S. PATENT DOCUMENTS 4,871,158 A 10/1989 May et al.
5,649,695 A 7/1997 Lawrence
6,330,999 B2 * 12/2001 Coombs et al. ..... 270/58.18
6,382,615 B1 * 5/2002 Ishiguro et al. ..... 270/58.12
6,443,450 B1 9/2002 Antinora
6,450,492 B1 * 9/2002 Coombs et al. ..... 270/58.08
6,450,934 B1 * 9/2002 Coombs ..... 493/383
6,581,922 B2 * 6/2003 Kuwata et al. ..... 270/58.11

* cited by examiner

*Primary Examiner*—Patrick Mackey

(57) ABSTRACT

A finishing device having a sheet guiding and buffering mechanism located in the space between a sheet transporting assembly and a finishing platform. The mechanism has two parallel retractable arms having a slight curvature along their length. Sheets dispensed seriatim from the transport assembly onto the arms conform to the curvature of the arms. In a normal mode, the arms are retracted for each sheet delivered thereto and the individual sheets drop onto platform to form a set of stacked sheets. When the last sheet of a set is dropped, the mechanism changes to a buffering mode and the arms collect and hold the first few sheets of the next set. Once the previous set has been finished and ejected from the platform, the arms are retracted and the sheets collected are dropped, and the mechanism is changed to the normal cycle for the remainder of the subsequent set.

12 Claims, 4 Drawing Sheets

FINISHING DEVICE HAVING A SHEET GUIDING AND BUFFERING MECHANISM

BACKGROUND OF THE INVENTION

The present invention relates to a finishing device for sets of sheets received from a document creating apparatus, such as a copier or printer and, more particularly, to an improved finishing device having a sheet guiding and buffering mechanism that enables full productivity for compiling without interruption of document creation, redundant compiling stations, or skipping of pitches.

Many finishing devices and sheet stacking devices are known in the sheet handling equipment industry, involving collating or stacking of sheets into sets of sheets and finishing each set of sheets by stapling or binding prior to depositing the finished sets of sheets on a collection tray. In the general prior art devices, the finishing operation on the compiled sets of sheets is accomplished following the completion of the successive sets of sheets in a subsequent finishing operation. Thus, the rate of speed at which the finishing device operates is adversely effected because all of collective functions of a finishing device, such as, for example, collection of sets, stapling of sets, and the deposition of stapled sets, are all performed in sequence. This results in loss of time for the performance of the several independent finishing device functions.

The solution-for the loss of productivity has been approached in the prior art on several fronts. One solution was to provide multiple redundant compiling stations, so when one set of sheets is being finished, the subsequent set of sheets is being directed to and compiled on a different compiling station. Another solution was to skip pitches in the document creating device, so that there was a time delay between sets of sheets received by the finishing device. The preferred solution to prevent loss of productivity by a finishing device, especially for a finishing device for a high volume copier or printer, is to provide a means for buffering or temporarily storing the sheets of subsequent sets of sheets in the finishing device. The following examples are attempts to provide a type of buffering in a finishing device.

U.S. Pat. No. 5,649,695 discloses a sheet stacker and finisher apparatus in which a multi-page set of sheets delivered from a copier or printer are collected at an assembly station. During the feeding of sheets comprising the set of sheets, a jogger is actuated to align side edges and to register the trail edges against a backstop and on an assembly bar. The sheet feeding and jogging continues until a complete set of sheets has been assembled. Upon completion of a set of sheets, the feeding of further sheets from the copier or printer is interrupted until the trail edge of the set of sheets is clamped or gripped and the set of sheets removed from the assembly station. At this time a subsequent set of sheets may be fed from the copier or printer onto the assembly station, while the previous set of sheets is being stapled and then stored on a storage table. Thus, less time is lost, because the interruption in sheets being fed to the sheet stacker and finisher is only for a relatively short time and not for completion of the finishing of the prior set of sheets.

U.S. Pat. No. 6,443,450 discloses sheet stacking apparatus having one or more rotatable disks, each with one or more slots for receiving sheets therein from a copier or printer. Once the leading edge of a sheet is inserted into the slots of the disks, a controller rotates the disk to invert and deposit the sheet on a vertically movable elevator platform. The receipt of the sheets by the slots in the disk followed by rotation and deposit on the previously deposited sheets on the elevator platform is continued until the set of sheets is completed. Sheets are continually fed from the copier or printer seriatim to the sheet stacking apparatus and to prevent interruption of sheeting feeding from the copier or printer, the disk retains the subsequently deposited sheet in its slot after completion of a prior set of sheets. The disk is rotated with the sheet in its slot to receive another sheet in the same slot of the disk, so that two or more sheets are retained in the disk slot, providing time to remove the completed set of sheets. As soon as the completed set of sheets is removed, the accumulated two or more sheets in the disk slot are removed and deposited on the elevator platform. Accordingly, buffering is provided at the cost of additional volume or space in the sheet stacker to accommodate the disks and with the added problem of sheet curl and sheet marking by the slots.

Though some of the prior art sheet stacking and finishing devices provide some improved productivity, none of the prior art sheet handling devices provide a full productivity, low-cost guiding and buffering mechanism suitable for high volume finishing which utilizes a minimum footprint or space requirement and which provides a guiding sheet path to handle sheets with down curl and weak sheet beam strength.

SUMMARY OF THE INVENTION

It is an object of the present invention to provide an improved low cost sheet guiding and buffering mechanism for a finishing device that enables full productivity for compiling and finishing sets of sheets received from a high volume document creating apparatus, such as a copier or printer.

It is another object of the invention to provide a sheet guiding and buffering mechanism for a finishing device that is located in the space between a sheet transport that receives the sheets seriatim from a document creating apparatus and a compiling and finishing tray, the guiding and buffering mechanism comprising two parallel retractable arms having a slight curvature that receives sheets from the sheet transport, guides the sheets, and retracts to drop the individually received sheets one at a time onto the compiling and finishing tray, but when the last sheet of a set is dropped, subsequently received sheets of the next set of sheets is retained on the arms until the previous set of sheets has been compiled, finished, and ejected from the tray.

In one aspect, of the invention, there is provided a finishing device for sets of sheets received from a document creating apparatus, comprising: a sheet transport assembly for receiving and transporting sheets from the document creating apparatus along a sheet process direction; a sheet guiding and buffering mechanism comprising two retractable arms, said arms being positioned adjacent each other at a location to receive sheets from the transport assembly, said arms being retracted in a direction away from and towards each other, said arms being located below and substantially parallel to said transport assembly; means for retracting and returning said arms along a path parallel to said transport assembly and perpendicular to said sheet process direction, whereby said arms vertically drop the sheets therefrom when the arms are retracted; a compiling and finishing platform for receiving the sheets dropped from the arms one on top of the other to form a stacked set of sheets, said platform having means to finish and eject the stacked set of finished sheets thereon; and said arms being retracted to deliver each sheet of a set of sheets individually to the compiling and finishing platform, once the last sheet of a set of sheets is delivered to the compiling and finishing platform, said arms remain in the location to receive sheets from the transport assembly to collect the first few sheets of the next incoming set of sheets, thereby providing a buffering cycle to enable time for the previous set of sheets to be finished and ejected to a collection tray, said arms being retracted to drop the accumulated first few sheets of the subsequent set of sheets onto said platform as soon as the previous set of sheets is finished and ejected.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
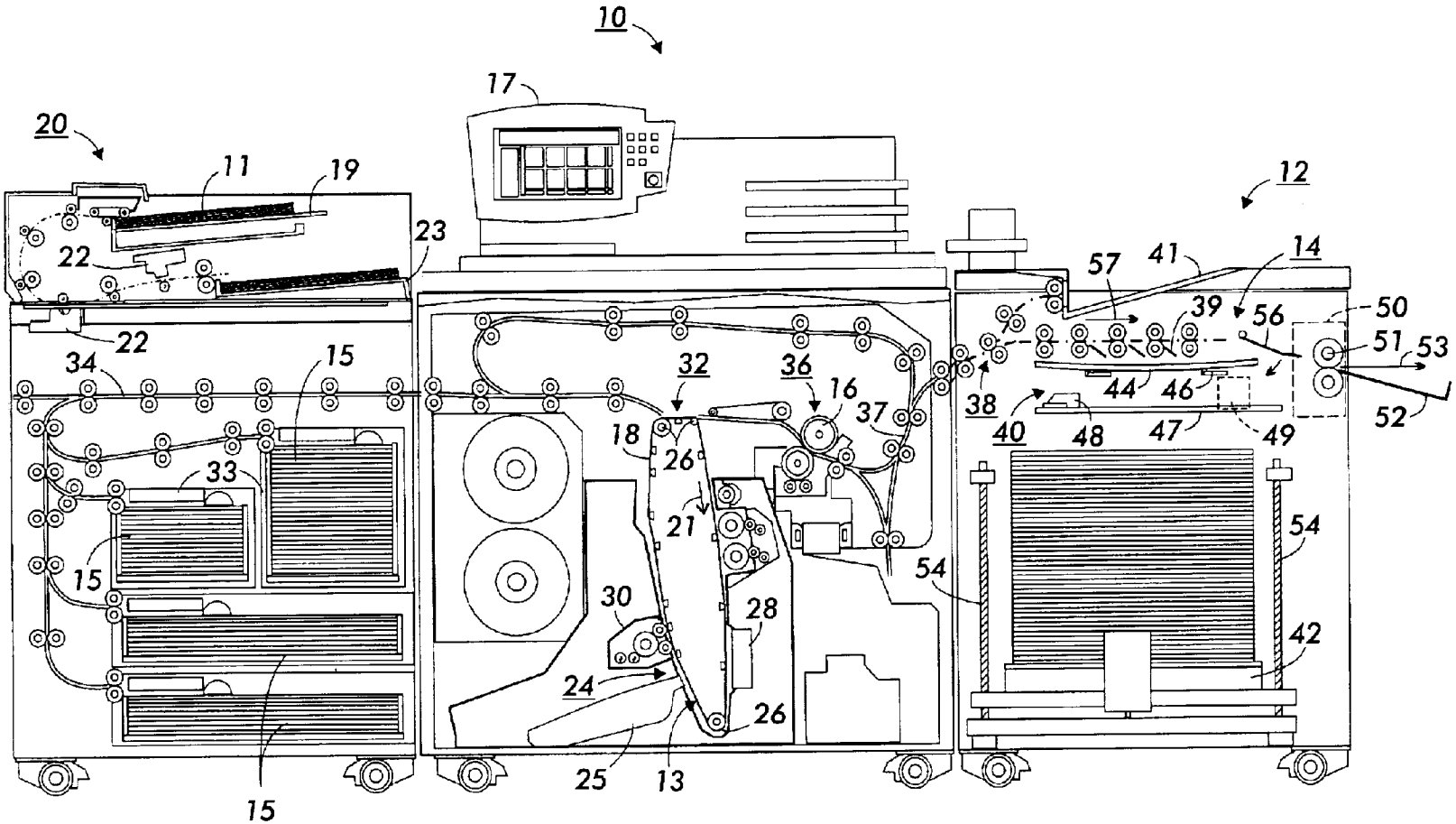
FIG. 1 is a schematic front elevation view of a finishing device incorporating the guiding and buffering mechanism of the present invention shown adjacent a high volume document creating apparatus, both shown in cross-section.

Referring to FIG. 1, there is shown a schematic front elevation view of the finishing device 12, incorporating the sheet guiding and buffering mechanism 14 of the present invention. The finishing device is shown adjacent a high-speed, high-volume document creating apparatus 10, such as, for example, a xerographic a copier or printer, from which a series of sheets with image reproductions thereon are fed seriatim to the finishing device for production of sets of these sheets. As in all xerographic machines, including the one illustrated in FIG. 1, a light image of an original document or set of documents 11 to be reproduced is projected or scanned onto a uniformly charged surface 13 of a photoreceptor 18 to form an electrostatic latent image thereon. Thereafter, the latent image is developed with an oppositely charged developing material called toner (not shown) to form a toner image, corresponding to the latent image on the photoreceptor surface. The toner image is then electrostatically transferred to a final support material or paper sheet 15, to which it may be permanently fixed by a fusing device 16.

In the illustrated apparatus 10 of FIG. 1, a set of original documents 11 to be copied is placed on tray 19 of an automatic document handler 20. The machine operator enters the desired copying instructions, such as, for example, number of copies or sets of copies, through the control panel 17. The automatic document handler transports the documents 11 serially from the tray and past a scanning station 22 where each document is scanned thereby producing digital image signals corresponding to the informational areas on the original document. Once scanned, the documents are deposited in an output tray 23. The image signals are projected upon the uniformly charged surface of the photoreceptor at an imaging station 24 by a raster output system 25 to form, a latent electrostatic image of the scanned informational areas of the original document thereon as the photoreceptor is moved passed the imaging station. The photoreceptor 18 is in the form of a flexible, endless belt having a photoconductive outer surface 13 and is mounted on a set of rollers 26. At least one of the rollers is driven to move the photoreceptor in the direction indicated by arrow 21 at a constant rate of speed about the rollers and past the various xerographic processing stations. Prior to entering the imaging station 24, the photoreceptor surface 13 is uniformly charged at a charging station 28. The exposure of the charged surface of the photoreceptor to the digital signals at the imaging station discharges the photoreceptor surface in the areas struck by the digital image signals. Thus, there remains on the photoreceptor surface a latent electrostatic image in image configuration corresponding to the informational areas on the original. As the photoreceptor continues its movement, the latent electrostatic image thereon passes through developing station 30 where oppositely charged toner is deposited on the latent electrostatic image to form a toner image.

The photoreceptor movement is continued transporting the toner image from the developer station to a transfer station 32. A sheet 15 is fed from a paper supply 33 to a sheet transport 34 for travel to the transfer station. The sheet is moved at a speed in synchronism with the moving photoreceptor and into aligned and, registered contact with the toner image. Transfer of the toner image to the sheet is effected and the sheet with the toner image is stripped from the photoreceptor and conveyed to a fusing station 36 having fuser device 16 where the toner image is fused to permanently fix the toner image to the sheet. After the toner image is fixed to the sheet, the sheet is transported by sheet transporting mechanism 37 to a finishing station 12 where the sheets with the permanent images thereon may be compiled into sets of sheets and finished by being stapled, bound, or the like.

Suitable drive means (not shown) for the document creating apparatus are arranged to drive the photoreceptor in timed relationship to the scanning of the original document and forming the latent electrostatic image on the photoreceptor, to effect development of the latent electrostatic image, to separate and feed sheets of paper, to transport same through the transfer station in time registration with the toner image, and to convey the sheet of paper with the toner image through the fusing station to fix the toner image thereto in a timed sequence to produce copies of the original documents.

The foregoing description is believed to be sufficient for the purposes of showing the general operation of a high-speed, high-volume document creating apparatus that is capable of producing 100 to 120 copies per minute. Thus, it is clear that such high speed, high volume copy producing machines require a finishing device capable of finishing sets of copies in a manner not to inhibit the productivity of the document creating apparatus.

Finishing device 12 comprises a sheet transport assembly 38 with diverter gate baffles 39, the sheet guiding and buffering mechanism 14 of the present invention, a compiling and finishing station 40, and a collection tray 42 for storing finished sets of sheets. The sheet transport assembly 38 receives and transports sheets 15 from the document creating apparatus 10 along a paper path indicated by arrow 57 to a selected and actuated one of the diverter gate baffles 39. The actuated diverter gate baffle, in cooperation with the drive rollers of the transport assembly 38, divert and, deposit the sheet onto the guiding and buffering mechanism in accordance with well known procedure. As will be described later, the sheet guiding and buffering mechanism comprises two elongated retractable arms 44, each being retractable by two arm links 46 and each having a surface 45 (see FIG. 3) onto which sheets are deposited by the transport assembly. The arm surfaces have a slight concave curvature along their length, exaggerated in FIG. 1 for emphasis. The purpose of the arm surface curvature is to cause the sheet or sheets deposited thereon to conform to the curvature and create some added beam strength that will prevent the sheets from buckling and slipping between and through the arms prematurely.

As shown in FIG. 1, the finishing device 12 has a top output tray 41 for receipt of sheets from the transport assembly 38 not requiring a finishing operation. The compiling and finishing station 40 comprises two retractable platforms 47 with a trail edge tamper 48 and side tampers 49 (shown in dashed line). Sheets are stacked and compiled into sets on platforms 47 and then each set of sheets is stapled or bound at the binding station 50, shown in dashed line. Drive rollers 51 at the binding station eject each finished set of sheets into pick up tray 52, as indicated by arrow 53, or return the finished set of sheets to a location on the platform 47. The two retractable platforms 47 are then retracted to allow the finished set to be dropped onto vertically movable collection tray 42. In this embodiment, the collection tray is vertically movable by, for example, vertical screws 54 at each corner of the tray. A stack height sensor (not shown) may be used to control the movement of the tray, so that the top of the last finished set of sheets thereon remains at substantially the same level.

The sheet guiding and buffering mechanism 14 performs two functions. The first function is to receive and immediately guide each sheet of a set of sheets onto the compiling and finishing station 40 into a stack of sheets. The stack of sheets is then aligned and registered by the trail edge tamper 48 and the side tampers 49 (shown in dashed line). The second function is to act as a buffer and temporarily collect and hold the first few sheets of a subsequent set of sheets. The buffering or second function provides the time necessary for the previous set of sheets to be finished and ejected onto the pick up tray 52 or collection tray 42 before the sheets of the next set is guided into a stack on the compiling and finishing station. The number of sheets collected during this second function is determined by the time required to finish and remove the previous set of sheets from the compiling and finishing station, and usually the collection of two or three sheets is sufficient.

Figure 2:
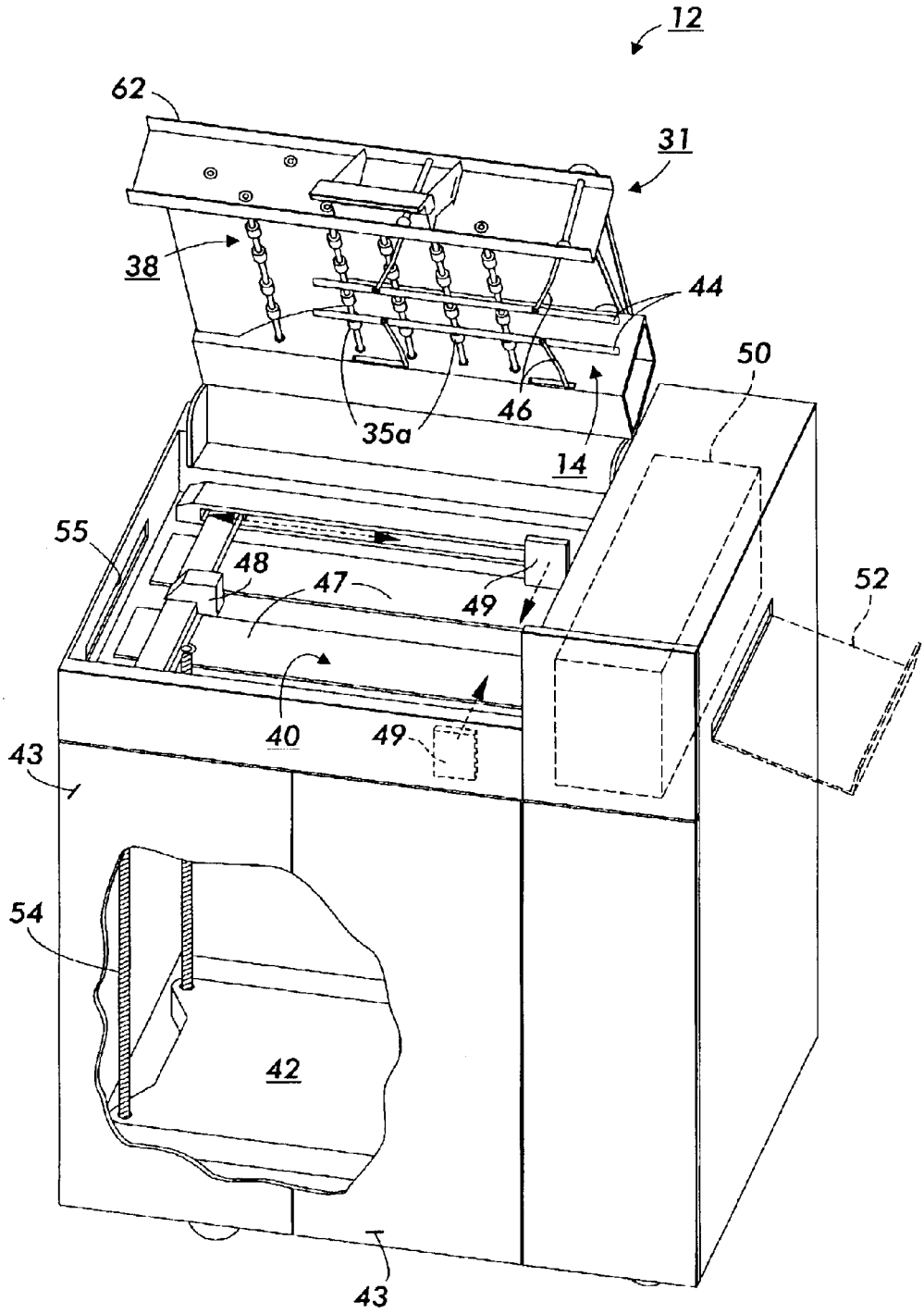
FIG. 2 is a schematic isometric view of the finishing device of FIG. 1 with the top cover open for a bottom view of the sheet guiding and buffering mechanism.

In FIG. 2, a schematic isometric view of the finishing device 12 is shown with the top portion 31 open in a clam shell fashion with some of the outer covers removed. The sheet transport assembly 38 and guiding and buffering mechanism 14 reside in the top portion and are substantially parallel to each other. The guiding and buffering mechanism is directly underneath the transport assembly. When the top portion is open, as is shown in FIG. 2, the underside of the guiding and buffering mechanism is exposed, showing two arm links 46 pivotally attached to the bottom of each of the arms 44. The compiling and finishing station 40 is located directly below the guiding and buffering mechanism, so that the platforms 47 thereof are shown, together with the trail edge tamper 48 and side tampers 49. The front doors 43 that are used to gain access to the finished sets of sheets stored on the collection tray 42 are partially removed to expose the vertically movable collection tray and the screws 54 which raise and lower the tray. The binding station 50 and pick up tray 52 are both shown in dashed lines.

In a typical finishing operation by the finishing device 12, sheets 15 from the document creating apparatus enter the finishing device 12 through aperture 55, shown in FIG. 2, one after another at the same speed as they are generated by the document creating apparatus. The drive rollers 35 of the sheet transport assembly 38 move the sheets entering aperture 55 along a horizontal sheet flow path to a one of the diverter gate baffles 39 of the transport assembly that has been actuated to accommodate the size of the sheet comprising the set of sheets to be finished. The actuated diverter gate baffle directs the sheets onto the two retractable arms 44 of the guiding and buffering mechanism 14. The arms 44 are located directly below and substantially parallel to the transport assembly 38 and are positioned adjacent but spaced apart from each other at locations approximately equal distanced from the center of the transport assembly paper path for ready receipt of sheets. The sheet is fed onto the relatively close arms 44 below the transport assembly, thereby reducing the adverse aerodynamic effects of down curl. When the sheet is completely on the arms, the sheet may conform to the slight curvature that runs along the length of the arms. This slight curve or bend in the sheet creates some added beam strength and helps prevent the sheet from sagging between the arms and prematurely falling from the arms. Next, the arms 44 are retracted by the arm links 46 to move them apart and, concurrently, plastic or wire like baffles 56 (see FIG. 1) are pivotably rotated about one end into contact with the leading edge of the sheet, so that the sheet is guided downwardly onto the compiling and finishing station. The baffles 56 function to dampen, slow down and push the leading edge of the sheet in a downward direction. Each sheet in a set are placed one on top of the other by the above process and aligned by the trail edge tamper 48 and side tampers 49, until the entire set of sheets is stacked on the compiling and finishing station.

Once the last sheet of the set of sheets is guided into the platforms 47 of the compiling and finishing station 40, the alignment and registration of the set of sheets is completed by the trail edge and side tampers 48,49. Then the aligned set of sheets is moved to a binding station 50 (shown in dashed line). At the binding station, the set of sheets may be stapled or bound and then ejected to a pickup tray 52 or deposited on the collection tray 42 where a quantity of finished sets of sheets may be accumulated. The side tampers may assist in the downward fall of the set of finished sheets. Time is required to finish the set of sheets, after a complete set of sheets has been deposited on at the compiling and finishing station, and to deposit and store the finished set of sheets on the collection tray. In order to allow enough time for the previous set of sheets to be finished and ejected to the pickup tray 52 or stored on the collection tray 42, the arms are returned to the sheet receiving location after the last sheet of each set of sheets to create a temporary buffering station. The arms are maintained at the receiving location in order to catch and hold the first few sheets of the next incoming set of sheets. This temporary holding of a few sheets of the next incoming set of sheets provides the required time to finish the preceding set of sheets. Again, the multiple sheets deposited on the arms may conform to the slight curvature of the arms. This creates sufficient beam strength in the sheets to prevent slippage or sag by the sheets that would cause the sheets to drop prematurely from the arms.

Once the finishing and ejection of the previous set of sheets is completed, the arms 44 are retracted by the arm links 46 and the accumulated sheets are dropped and guided with the aid of the baffles 56 and the side tampers 49. The rest of the sheets of the set of sheets, if any, are guided one at a time as described above to complete the next set of sheets on the platforms 47 of the compiling and finishing station 40. Thus, the arms 44 are retracted and returned for each remaining sheet of the set of sheets, until the second or subsequent set of sheets is completed. Then the buffering cycle of the guiding and buffering mechanism 14 is repeated as before to catch and hold the first few sheets of the next set of sheets. This process is repeated until all of the sets of sheets is completed and ejected or stored on the collection tray.

A horizontally driven paddle type gate 58 (shown in FIG. 4) is positioned at or near the trail edge of the sheet or sheets residing on the arms 44. The paddle type gate is positioned near the trail edge of the stored sheets, and may be actuated by controller 80 to contact the stored sheets and help to prevent the sheet or sheets from being dragged by the arms while the arms are being retracted to drop the sheets. Concurrently, the baffles 56 aid in guiding the is leading edge of the sheet or sheets onto the platforms 47 of the compiling and finishing station 40.

Figure 3:
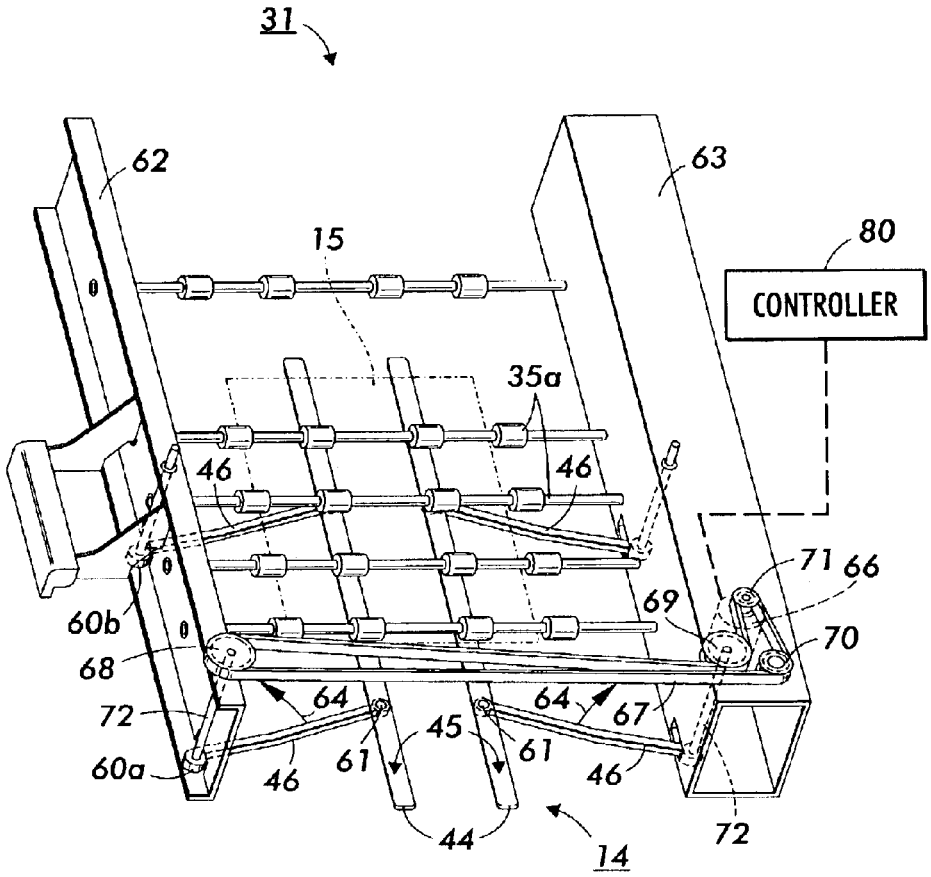
FIG. 3 is a top isometric view of the sheet guiding and buffering mechanism shown with a portion of the sheet transport and covers removed.

Referring to FIG. 3, a top isometric view of the sheet guiding and buffering mechanism 14 is shown with a portion of the sheet transport assembly 38 and covers removed. The arm links 46 and hinges 60*a*,60*b* that retract or pivot the arms 44 are better seen in this view. One end of the arm links 46 is pivotally attached to the underside of the retractable arms 44 by pins 61. Each retractable arm has two arm links 46. The other end of each of the arm links is attached to hinges 60*a*,60*b* mounted on respective frame members 62,63 of the top portion 31 of the finishing device 12 that opens in a clam shell like manner. The bottom rollers 35*a* of the transport assembly 38 are shown With the retractable arms 44 located substantially parallel to and directly below the bottom rollers 35*a* and in the position to receive sheets. Arrows 64 show the direction of retraction or pivoting of the arms 44 by the arm links 46. A sheet 15 is shown on the arms 44 in dashed line. The arms 44 are retracted outwardly in the direction of arrows 64 to clear each side of the sheet 15 and permit the sheet to be dropped and guided by the baffles 56 (see FIG. 4) and side tampers 49 (see FIG. 2). The dropped sheet is aided and guided by the paddle like gate 58 (see FIG. 4). A single reversible drive motor 66 (shown in dashed line) drives and actuates the retracting and the returning of the arms 44 to the sheet receiving position by a timing belt 67 mounted on a set of pulleys 68,69,70. Pulley 68 is mounted on frame member 62 and a pair of pulleys 69,70 is mounted on the other frame member 63. The timing belt 67 is entrained around the pulleys 68,69,70 and a pulley 71 mounted on the drive shaft of the motor 66 (shown in dashed line). The pulleys 68,69 mounted on respective frame members 62,63 are each fixed to a shaft 72 rotatably mounted on the respective frame members for rotation about the shaft axis. The pulley shaft is perpendicular to the horizontal plane of movement of the arms 44. The hinges 60*a* are each attached to the pulley shaft 72, so that back and forth rotation of the motor shaft causes the arms to be retracted and returned to the sheet receiving location. The other hinges 60*b* are not driven.

The motor 66 is controlled by a controller 80 to retract the arms 44 from and return to the position to receive sheets 15 from the sheet transport assembly 38. Controller 80 is shown as a single controller, but may alternately be logic circuits or a part of an overall finishing device controller. A sensor (not shown) located at or after the entrance aperture 55 detects the presence of a sheet entering the finishing device 12 and sends a signal to the controller 80. Each time a signal is received by the controller 80, programmed logic stored therein timely actuates the appropriate diverter gate baffle 39, retracts and returns the arms 44, etc.

Figure 4:
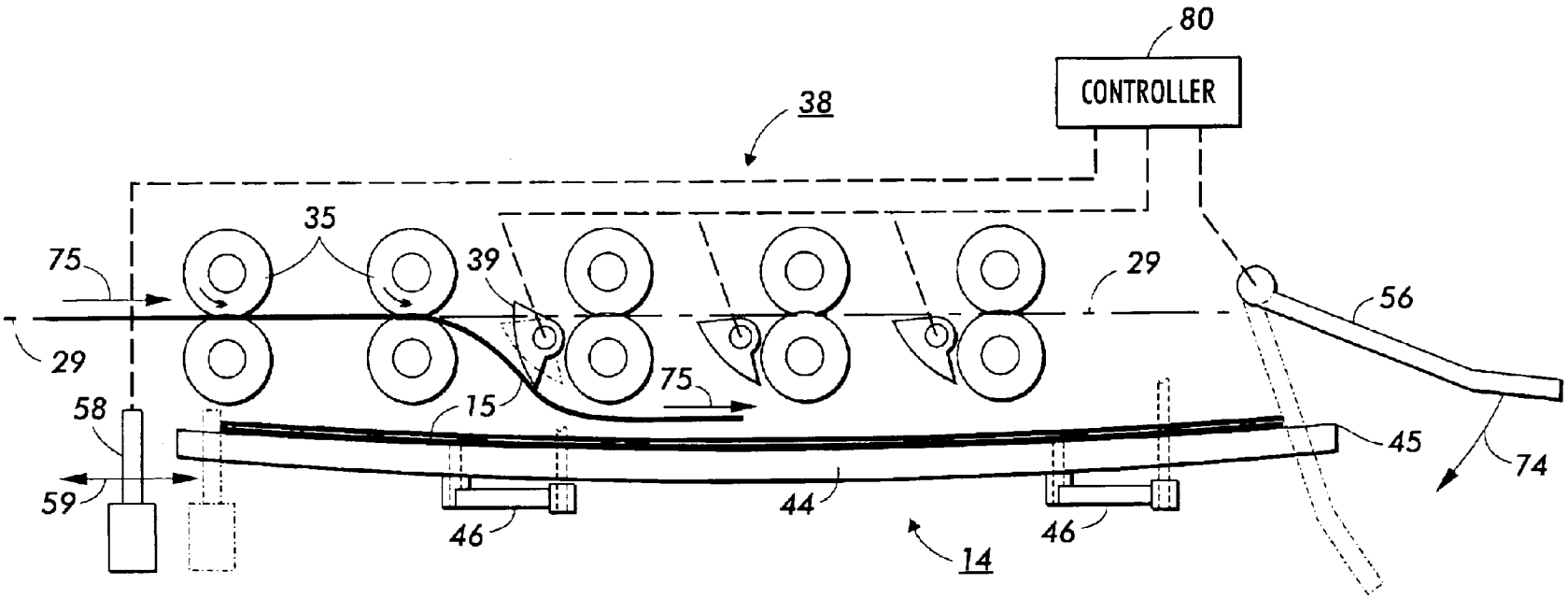
FIG. 4 is a schematic side view of the sheet guiding and buffering mechanism shown functioning in a buffering mode.

In FIG. 4, a schematic side view of the sheet guiding and buffering mechanism 14 is shown functioning in a buffering mode. Again, the concave curvature of the arms 44 has been exaggerated to emphasize the importance of the curvature of the upper surface 45 of the arms 44. The direction of curvature of the arms is along their length. In one embodiment, the curvature of the arms may be in the direction from the ends adjacent the trail edge of the sheets to the ends adjacent the lead edge of the sheets when the sheets reside on the arms 44. In one embodiment, the slope of the curvature starts at one end and ends at the other end. In the embodiment shown, the curvature begins at about the center of the arm and curves toward each end. In either case the slope of the curvature is about 1 mm in 50 mm of arm length. The width of the surface of the arms is about 18 mm, and the arm length is about 410 mm. The spacing between the frame members 62,63 comprising the top portion 31 of finishing device 12 is sufficient to accommodate the size of the sheets to be handled by the finishing device.

The appropriate diverter gate baffle 39 is actuated in response to the controller 80 by in suitable means, such as, for example, a solenoid or other drive means (not shown), so that the transport assembly 38, in conjunction with the diverter gate baffle, guides the sheets 15 from the sheet flow path 29 (shown in dashed line) onto the arms 44 one after the other, as indicated by arrows 75. In the buffering mode, the arms are not retracted after each sheet is deposited thereon, but instead collect the required number of sheets of the next incoming set to allow time for the previous set to be finished and removed from the compiling and finishing station. Once the previous set of sheets have been finished and removed from the compiling and finishing station, the arm drive motor 66 (see FIG. 3) actuates the arm links 46 and retracts the arms 44. When the arms are retracted,the accumulated sheets are delivered to the platforms 47 of the compiling and finishing station 40 below, with the aid of the baffles 56, side tampers 49 and paddle gate 58, all of which are under the control of the controller 80. The baffle 56 is shown moving in the direction of arrow 74 from a position above the sheet or sheets to a position contacting the leading edge of the sheet or sheets, as shown in dashed line.

Accordingly, the above described guiding and buffering mechanism for a finishing device, enables full productivity for compiling and finishing set of sheets received from a high speed, high volume document creating apparatus. Redundant processing stations and skipped pitches have been avoided. This cost effective invention reduces the footprint or volume requirements to provide buffering by utilizing the space between the input sheet transport assembly 38 and the compiling and finishing station 40 for retractable arms 44 that enable vertical sheet delivery. The curvature of the surface 45 of the retractable arms. 44 creates beam strength in the sheets 15 deposited on the arms, thereby reducing corrugation requirements to feed sheets into the compiling and finishing station and thus reduces sheet marking caused by the corrugation requirements. Also, the close proximity of the arms to the sheet transport assembly helps handle sheets with down curl. This invention enables a finishing device to be used for a higher volume document creating apparatus without sacrificing productivity thereof.

Although the foregoing description illustrates the preferred embodiment, other variations are possible and all such variations as will be apparent to those skilled in the art are intended to be included within the scope of this invention as defined by the following claims.

What is claimed is:

1. An improved finishing device for sets of sheets received from a document creating apparatus, comprising:

a sheet transport assembly for receiving and transporting sheets along a sheet processing direction;

a sheet guiding and buffering mechanism comprising two retractable arms, said arms being positioned adjacent each other at a location to receive sheets from the transport assembly said arms being retracted in a direction away from and towards each other, said arms being located below and substantially parallel to said transport, each of the arms having a coplanar surface confronting said transport assembly;

means for retracting and returning said arms along a path parallel to said transport assembly and perpendicular to said sheet processing direction, whereby said arms vertically drop the sheets therefrom when the arms are retracted;

a compiling and finishing platform for receiving the sheets dropped from the arms one on top of the other to form a stacked set of sheets, said platform having means to finish and eject the set of sheets stacked thereon; and said arms being retracted to deliver each sheet of a set of sheets individually to the compiling and finishing platform, once the last sheet of a set of sheets is delivered to the compiling and finishing platform, said arms remain in the location to receive sheets from the transport assembly to collect the first few of the sheets of the next incoming set of sheets, thereby providing a buffering cycle to enable time for the previous set of sheets to be finished and ejected to a collection tray, said arms being retracted to drop the accumulated sheets of the subsequent set of sheets onto said platform as soon as the previous set of sheets is finished.

2. The finishing device as claimed in claim 1, wherein each of said arms of said guiding and buffering mechanism have a curvature along the length thereof, so that the sheets residing on the arms conform to the curvature of said arms, thereby creating increased beam strength in said sheets.

3. The finishing device as claimed in claim 2, wherein the transport assembly has diverter gate baffles to divert sheets therefrom onto said arms.

4. The finishing device as claimed in claim 2, wherein after the first few sheets of the next incoming set of sheets are delivered to said platform, said arms of said guiding and buffering mechanism are retracted to deliver each sheet, if any, of the remaining sheets of said subsequent set of sheets individually to the platform.

5. The finishing device as claimed in claim 4, wherein the means for retracting and returning said arms comprises a pair of parallel arm links for each retractable arm, one end of each pair of arm links being pivotally attached to a respective one of the retractable arms the other end of each pair of arm links being attached to fixedly mounted hinges, and a reversible drive motor drivingly connected to said hinges by a set of pulleys and a timing belt entrained around said pulleys.

6. The finishing device as claimed in claim 4, wherein the sheet guiding and buffering mechanism further comprises a baffle pivotably mounted at one end thereof for rotation about said pivotably mounted end into contact with a leading edge of each sheet when said arms are retracted, thereby downwardly guiding said sheets being delivered to said platform.

7. The finishing device as claimed in claim 6, wherein the sheet guiding and buffering mechanism further comprises a movable paddle gate baffle horizontally driven into contact with the trailing edge of said sheets residing on said two retractable arms, when said two retractable arms are retracted, in order to prevent the two retractable arms from dragging said sheets.

8. An improved finishing device for sets of sheets received from a document creating apparatus, comprising:

a sheet transport assembly for receiving and transporting sheets from the document creating apparatus along a sheet processing direction;

a sheet guiding and buffering mechanism comprising two retractable arms, said arms being positioned adjacent each other at a location to receive sheets from the transport assembly, said arms being retracted in a direction away from said poison to receive sheets, in order to drop and guide sheets therefrorn, said arms being located below and substantially parallel to said transport assembly, each of said arms having a surface confronting said transport assembly, said surface of the arms being coplanar and having a slight curvature;

means for retracting and returning said arms from a position to receive sheets from said transport assembly along a path parallel to said transport assembly and perpendicular to said sheet processing direction, said arms being retracted after each sheet of a set of sheets is deposited thereon by said transport assembly by said transport assembly in order to drop and guide the sheets therefrom;

a compiling and finishing platform for receiving the sheets dropped from the arms, the sheets being delivered to the platform each time said arms are retracted, after the last sheet of a set of sheets is delivered to the platform, the set of sheets being registered, compiled, and finished prior to ejection to a collection tray; and during the time required to finish and eject the set of sheets, said means for retracting and returning said arms maintains the arms in said location to receive sheets, so that said arms collects and holds the first few sheets of the next incoming set of sheets, thereby providing a buffering station for the subsequent set of sheets, once the previous set of sheets has been finished and ejected from said platform, said arms being retracted to deliver the total quantity of sheets collected thereon to the collection tray and each subsequent sheet of the succeeding set of sheet is thereafter delivered one sheet at a time to said platform.

9. A method of sheet guiding and buffering in a finishing device that enables full productivity for finishing sets of sheets from a high volume document creating apparatus, said method comprising the steps of:

(a) transporting sheets received seriatim from the document creating apparatus with a transport assembly;

(b) providing a pair of parallel retractable arms located below said transport assembly, said retractable arms each having a surface with a curvature for holding said sheets;

(c) diverting each individual sheet from said transport assembly onto said surfaces of the retractable arms;

(d) retracting said retractable arms away from each other, after each sheet is diverted thereon from said transport assembly to enable each sheet to drop vertically therefrom;

(e) concurrently guiding each sheet being dropped by the retracting of said retractable arms onto a compiling and finishing station;

(f) stacking and aligning the sheets on said compiling and finishing station to form sets of stacked sheets;

(g) preventing the retraction of said retractable arms after a last sheet of a previous set of sheets has been dropped by said retractable arms to provide a buffer for collecting a first few sheets of a next subsequent set of sheets being diverted from the transport assembly onto said retractable arms, thereby providing time for finishing of said previous set of sheets;

(h) finishing and removing said previous set of sheets from the compiling and finishing station;

(i) retracting said retractable arms to drop the collected first few sheets of said next subsequent set of sheets;

(j) concurrently guiding the collected first few sheets of the next subsequent set of sheets being dropped by the retraction of said retractable arms onto said compiling and finishing station; and (k) continuing with a return to step (d) through step (k) until all of the sets of sheets have been finished by said finishing device.

10. A sheet compiling and finishing system for printed sheets outputted by a printing system, comprising:

a stacking a tray system for stacking plural sets of plural said printed sheets, and an overlying partial sheet supporting system adapted to temporarily support plural said printed sheets being fed thereto in a first direction.

said partial sheet supporting system including two relatively moveable partial sheet supporting members extending in said first direction, said two relatively moveable partial sheet supporting members being spaced above said stacking tray system said two relatively moveable sheet supporting members being moveable away from one another transversely of said first direction by a distance sufficient to allow said plural printed sheets temporarily supported thereon to drop downwardly in between said two relatively moveable partial sheet supporting members towards said stacking tray system wherein said partial sheet supporting system includes a sheet input path thereto having plural independently actuatable baffle gates spaced thereover in said first direction for providing different sheet input positions to said partial sheet supporting system for different size sheets.

11. The sheet compiling and finishing system of claim 10 wherein an intermediate level sheets supporting surface is provided in between said overlying sheet supporting system and said stacking tray system whereby said plural sheets temporarily supported on said two relatively moveable partial sheet supporting members first drop to said intermediate level sheet supporting surface and then to said stacking tray system.

12. The sheet compiling and finishing system of claim 11 wherein said intermediate level sheets supporting surface includes a finishing station for fastening plural said sheets together in collated sets.

* * * * *